US009165419B2

(12) United States Patent
Heymann

(10) Patent No.: US 9,165,419 B2
(45) Date of Patent: Oct. 20, 2015

(54) SLOT MACHINE BONUS GAME PROVIDING AWARDS FOR MANUAL DEXTERITY

(75) Inventor: Jorge Heymann, Buenos Aires (AR)

(73) Assignee: Etasse Limited, Alderney (GB)

( * ) Notice: Subject to any disclaimer, the term of this patent is extended or adjusted under 35 U.S.C. 154(b) by 1053 days.

(21) Appl. No.: 11/874,409

(22) Filed: Oct. 18, 2007

(65) Prior Publication Data

US 2008/0119261 A1 May 22, 2008

Related U.S. Application Data

(60) Provisional application No. 60/862,561, filed on Oct. 23, 2006.

(51) Int. Cl.
*A63F 9/24* (2006.01)
*G07F 17/32* (2006.01)

(52) U.S. Cl.
CPC ..... *G07F 17/32* (2013.01); *G07F 17/3267* (2013.01); *G07F 17/3295* (2013.01)

(58) Field of Classification Search
USPC ..... 463/1, 7, 10–14, 16–23, 25–27, 29–34, 463/42; 273/138.1, 138.2, 139, 141 A, 273/142 B, 142 C, 142 J, 317.1, 453, 273/460–461
IPC ..... A63F 13/00,13/12, 9/24; A63B 71/06
See application file for complete search history.

(56) References Cited

U.S. PATENT DOCUMENTS 4,836,546 A 6/1989 DiRe et al.
4,844,476 A * 7/1989 Becker ..... 463/5
5,033,744 A 7/1991 Bridgeman et al.
5,342,049 A 8/1994 Wichinsky et al.
5,401,023 A 3/1995 Wood
5,401,024 A 3/1995 Simunek
5,411,271 A 5/1995 Mirando
5,456,465 A 10/1995 Durham
5,511,781 A 4/1996 Wood et al.
5,676,371 A * 10/1997 Kelly et al. ..... 273/115
5,704,835 A 1/1998 Dietz, II
5,720,662 A 2/1998 Holmes et al.
(Continued)

FOREIGN PATENT DOCUMENTS

EP 1063622 12/2000
EP 1652562 5/2006
(Continued)

OTHER PUBLICATIONS

European Patent Office, Supplementary European Search Report for European Application No. EP 06 71 8145, Apr. 30, 2010.
(Continued)

*Primary Examiner* — Omkar Deodhar
(74) *Attorney, Agent, or Firm* — McDonnell Boehnen Hulbert & Berghoff LLP

(57) ABSTRACT

A slot machine method, apparatus, and computer readable storage to implement a bonus round for a slot machine game that allows players to use manual dexterity in order to earn prizes in a bonus round. Moving elements can be selected (e.g., shot, touched, etc.) and if successfully selected, the player can earn a bonus award. Bonus awards can accumulate until the bonus round is over. The bonus round can end when either a predefined time is over or the player selects a termination element.

20 Claims, 5 Drawing Sheets

(56) References Cited

U.S. PATENT DOCUMENTS 5,769,716 A 6/1998 Saffari et al.
5,823,874 A 10/1998 Adams
5,833,537 A 11/1998 Barrie
5,947,821 A 9/1999 Stone
5,976,016 A 11/1999 Moody et al.
6,001,016 A 12/1999 Walker et al.
6,015,346 A 1/2000 Bennett
6,059,659 A 5/2000 Busch et al.
6,070,874 A 6/2000 Ivers
6,120,298 A 9/2000 Jenkins et al.
6,129,632 A 10/2000 Luciano
6,159,097 A 12/2000 Gura
6,174,235 B1 1/2001 Walker et al.
6,186,894 B1 2/2001 Mayeroff
6,193,606 B1 2/2001 Walker et al.
6,210,275 B1 * 4/2001 Olsen ..... 463/16
6,224,483 B1 5/2001 Mayeroff
6,270,409 B1 8/2001 Shuster
6,287,197 B1 9/2001 Dickinson et al.
6,338,678 B1 1/2002 Seelig et al.
6,346,043 B1 2/2002 Colin et al.
6,347,996 B1 2/2002 Gilmore et al.
6,358,147 B1 * 3/2002 Jaffe et al. ..... 463/20
6,390,473 B1 5/2002 Vancura et al.
6,394,899 B1 5/2002 Walker
6,413,161 B1 7/2002 Baerlocher et al.
6,425,824 B1 7/2002 Baerlocher et al.
6,450,888 B1 * 9/2002 Takase et al. ..... 463/43
6,485,367 B1 11/2002 Joshi
6,497,576 B1 * 12/2002 Smith ..... 434/236
6,547,242 B1 4/2003 Sugiyama et al.
6,554,283 B2 4/2003 Vancura et al.
6,575,831 B1 6/2003 Gonen et al.
6,595,854 B2 * 7/2003 Hughs-Baird et al. ..... 463/20
6,601,850 B1 8/2003 Ross
6,604,740 B1 8/2003 Singer et al.
6,609,971 B2 8/2003 Vancura
6,609,974 B2 * 8/2003 Mead et al. ..... 463/25
6,641,477 B1 11/2003 Dietz et al.
6,663,489 B2 * 12/2003 Baerlocher ..... 463/20
6,666,765 B2 12/2003 Vancura
6,669,559 B1 12/2003 Baerlocher et al.
6,695,696 B1 2/2004 Kaminkow
6,709,332 B2 3/2004 Adams
6,731,313 B1 5/2004 Kaminkow
6,752,396 B2 6/2004 Smith
6,761,632 B2 * 7/2004 Bansemer et al. ..... 463/16
6,769,986 B2 8/2004 Vancura
6,780,103 B2 * 8/2004 Bansemer et al. ..... 463/7
6,780,107 B2 8/2004 Baerlocher et al.
6,786,819 B2 * 9/2004 Baerlocher et al. ..... 463/20
6,811,486 B1 11/2004 Luciano, Jr.
6,830,514 B2 12/2004 Meyer et al.
6,855,054 B2 * 2/2005 White et al. ..... 463/21
6,860,810 B2 * 3/2005 Cannon et al. ..... 463/20
6,863,606 B1 3/2005 Berg et al.
6,869,360 B2 3/2005 Marks et al.
6,884,165 B2 4/2005 Baerlocher
6,890,257 B2 5/2005 Baerlocher
6,896,260 B2 5/2005 Pierce
6,902,481 B2 6/2005 Breckner et al.
6,938,068 B1 8/2005 Kraft et al.
6,939,223 B1 9/2005 Jones
6,942,568 B2 9/2005 Baerlocher
6,942,571 B1 9/2005 McAllister et al.
6,950,993 B2 * 9/2005 Breinberg ..... 715/801
6,964,416 B2 11/2005 McClintic et al.
6,966,836 B1 11/2005 Rush et al.
6,984,174 B2 * 1/2006 Cannon et al. ..... 463/25
6,991,539 B2 1/2006 Pacey
6,997,805 B2 2/2006 Vancura
7,036,083 B1 * 4/2006 Zenith ..... 715/758
7,056,210 B2 * 6/2006 Bansemer et al. ..... 463/16
7,066,811 B1 6/2006 DeFrees-Parrott et al.
7,147,559 B2 12/2006 Englman
7,175,524 B2 * 2/2007 Bansemer et al. ..... 463/16
7,175,527 B2 2/2007 Bryant
7,192,346 B2 3/2007 Mathis
7,252,589 B1 8/2007 Marks et al.
7,264,545 B2 9/2007 Maya et al.
7,275,989 B2 10/2007 Moody
7,326,115 B2 * 2/2008 Baerlocher ..... 463/25
7,341,513 B2 3/2008 Cuddy et al.
7,364,506 B2 * 4/2008 Jaffe et al. ..... 463/20
7,367,883 B2 5/2008 Gagnon
7,371,173 B2 5/2008 Gatto et al.
7,377,850 B2 5/2008 Shackelford et al.
7,393,278 B2 7/2008 Gerson et al.
7,470,193 B2 * 12/2008 Umezaki ..... 463/31
7,534,168 B2 * 5/2009 Bennett et al. ..... 463/20
7,559,836 B2 7/2009 Gerson et al.
7,585,219 B2 9/2009 Randall et al.
7,631,872 B2 12/2009 Roemer et al.
7,690,996 B2 4/2010 Iddings et al.
7,713,123 B2 5/2010 Gerson et al.
7,727,063 B2 6/2010 Walker et al.
7,753,790 B2 7/2010 Nguyen et al.
7,771,279 B2 * 8/2010 Miyamoto et al. ..... 463/31
7,789,749 B2 * 9/2010 Bansemer et al. ..... 463/20
7,819,748 B2 * 10/2010 Ajioka ..... 463/37
7,846,015 B2 * 12/2010 Bansemer et al. ..... 463/16
8,113,940 B2 * 2/2012 Hornik ..... 463/20
8,231,453 B2 * 7/2012 Wolf et al. ..... 463/20
8,475,262 B2 * 7/2013 Wolf et al. ..... 463/20
2001/0003709 A1 6/2001 Adams
2001/0009865 A1 7/2001 Demar et al.
2001/0031659 A1 10/2001 Perrie et al.
2002/0010017 A1 1/2002 Bennett
2002/0027323 A1 3/2002 Vancura et al.
2002/0043759 A1 4/2002 Vancura
2002/0045474 A1 4/2002 Singer et al.
2002/0049082 A1 4/2002 Bansemer et al.
2002/0049802 A1 4/2002 Nakahara et al.
2002/0052234 A1 5/2002 Adams
2002/0058545 A1 5/2002 Luciano
2002/0077165 A1 6/2002 Bansemer et al.
2002/0198044 A1 12/2002 Walker et al.
2003/0003980 A1 1/2003 Moody
2003/0013514 A1 1/2003 Cregan et al.
2003/0022711 A1 1/2003 Locke et al.
2003/0027619 A1 2/2003 Nicastro
2003/0027639 A1 2/2003 Peterson et al.
2003/0036423 A1 2/2003 Vancura
2003/0040355 A1 2/2003 Baerlocher
2003/0060276 A1 3/2003 Walker et al.
2003/0060278 A1 3/2003 Walker et al.
2003/0060281 A1 3/2003 Vancura
2003/0064782 A1 4/2003 Beaulieu et al.
2003/0064797 A1 4/2003 Jackson et al.
2003/0064800 A1 4/2003 Jackson et al.
2003/0092476 A1 5/2003 Fox
2003/0092480 A1 5/2003 White et al.
2003/0100361 A1 5/2003 Sharpless et al.
2003/0119576 A1 6/2003 McClintic et al.
2003/0119581 A1 * 6/2003 Cannon et al. ..... 463/25
2003/0119756 A1 6/2003 Gaeta et al.
2003/0125107 A1 7/2003 Cannon
2003/0130027 A1 7/2003 Aida
2003/0153375 A1 8/2003 Vancura
2003/0162583 A1 * 8/2003 Baerlocher et al. ..... 463/20
2003/0162584 A1 8/2003 Hughs-Baird et al.
2003/0162585 A1 8/2003 Bigelow, Jr. et al.
2003/0181231 A1 9/2003 Vancura et al.
2003/0186733 A1 10/2003 Wolf et al.
2003/0195027 A1 10/2003 Baerlocher et al.
2003/0195034 A1 10/2003 Dunaevsky
2003/0224849 A1 12/2003 Geiger
2004/0014517 A1 1/2004 Inoue
2004/0023715 A1 2/2004 Luciano, Jr. et al.
2004/0036216 A1 2/2004 Vancura
2004/0048650 A1 3/2004 Mierau et al.
2004/0053657 A1 3/2004 Fiden et al.
2004/0053683 A1 3/2004 Hartl et al.
2004/0063483 A1 4/2004 Wolf et al.

(56) References Cited

U.S. PATENT DOCUMENTS

| | | | | |
|---|---|---|---|---|
| 2004/0072603 | A1 | 4/2004 | Shuster | |
| 2004/0072607 | A1* | 4/2004 | Thomas et al. | 463/16 |
| 2004/0092300 | A1 | 5/2004 | Gauselmann | |
| 2004/0116173 | A1 | 6/2004 | Baerlocher | |
| 2004/0121838 | A1 | 6/2004 | Hughs-Baird et al. | |
| 2004/0127280 | A1 | 7/2004 | Moody | |
| 2004/0152509 | A1 | 8/2004 | Hornik et al. | |
| 2004/0176157 | A1* | 9/2004 | Walker et al. | 463/16 |
| 2004/0198490 | A1 | 10/2004 | Bansemer et al. | |
| 2004/0204233 | A1 | 10/2004 | Saffari et al. | |
| 2004/0209662 | A1 | 10/2004 | Wadleigh | |
| 2004/0219969 | A1 | 11/2004 | Casey et al. | |
| 2004/0235548 | A1 | 11/2004 | Benbrahim | |
| 2004/0235556 | A1 | 11/2004 | Flemming et al. | |
| 2004/0242316 | A1 | 12/2004 | Oles et al. | |
| 2005/0014551 | A1 | 1/2005 | Packes et al. | |
| 2005/0014557 | A1 | 1/2005 | Duhamel | |
| 2005/0014563 | A1 | 1/2005 | Barri | |
| 2005/0026664 | A1* | 2/2005 | Bansemer et al. | 463/7 |
| 2005/0026679 | A1 | 2/2005 | Lucchesi et al. | |
| 2005/0032566 | A1 | 2/2005 | Baerlocher et al. | |
| 2005/0033711 | A1 | 2/2005 | Horvitz et al. | |
| 2005/0054416 | A1 | 3/2005 | Hostetler et al. | |
| 2005/0054430 | A1 | 3/2005 | Pitman et al. | |
| 2005/0085285 | A1 | 4/2005 | Muskin | |
| 2005/0090307 | A1 | 4/2005 | Walker et al. | |
| 2005/0107154 | A1 | 5/2005 | Pacey | |
| 2005/0119040 | A1 | 6/2005 | Berman et al. | |
| 2005/0130737 | A1 | 6/2005 | Englman et al. | |
| 2005/0137007 | A1 | 6/2005 | Schaufelberger | |
| 2005/0153765 | A1 | 7/2005 | Shoostine | |
| 2005/0153770 | A1 | 7/2005 | Vancura | |
| 2005/0164794 | A1 | 7/2005 | Tahara | |
| 2005/0176494 | A1 | 8/2005 | Thomas | |
| 2005/0181866 | A1 | 8/2005 | Baerlocher | |
| 2005/0187005 | A1 | 8/2005 | Rose | |
| 2005/0187023 | A1* | 8/2005 | Miyamoto et al. | 463/43 |
| 2005/0202864 | A1* | 9/2005 | Duhamel et al. | 463/16 |
| 2005/0202869 | A1 | 9/2005 | Miyamoto et al. | |
| 2005/0215311 | A1 | 9/2005 | Hornik et al. | |
| 2005/0266916 | A1 | 12/2005 | Sato et al. | |
| 2005/0277469 | A1 | 12/2005 | Pryzby et al. | |
| 2006/0003831 | A1 | 1/2006 | Falciglia | |
| 2006/0019738 | A1 | 1/2006 | Baerlocher et al. | |
| 2006/0030398 | A1* | 2/2006 | Hornik | 463/20 |
| 2006/0046818 | A1* | 3/2006 | Goins | 463/16 |
| 2006/0046853 | A1 | 3/2006 | Black | |
| 2006/0063584 | A1 | 3/2006 | Brill et al. | |
| 2006/0073863 | A1* | 4/2006 | Hagiwara | 463/9 |
| 2006/0073878 | A1 | 4/2006 | Shackelford et al. | |
| 2006/0121972 | A1 | 6/2006 | Walker et al. | |
| 2006/0121978 | A1 | 6/2006 | Hornik et al. | |
| 2006/0160595 | A1 | 7/2006 | Gerson et al. | |
| 2006/0160614 | A1 | 7/2006 | Walker et al. | |
| 2006/0172791 | A1 | 8/2006 | Wolf | |
| 2006/0181028 | A1 | 8/2006 | Benator | |
| 2006/0183536 | A1 | 8/2006 | Gagner et al. | |
| 2006/0189377 | A1 | 8/2006 | Gomez et al. | |
| 2006/0189378 | A1 | 8/2006 | Aoki | |
| 2006/0205483 | A1 | 9/2006 | Meyer et al. | |
| 2006/0240890 | A1 | 10/2006 | Walker et al. | |
| 2006/0247035 | A1 | 11/2006 | Rowe et al. | |
| 2006/0252494 | A1 | 11/2006 | Gerson et al. | |
| 2006/0252495 | A1 | 11/2006 | Gerson et al. | |
| 2006/0264255 | A1 | 11/2006 | Borissov | |
| 2007/0060254 | A1 | 3/2007 | Muir | |
| 2007/0060314 | A1 | 3/2007 | Baerlocher et al. | |
| 2007/0077988 | A1 | 4/2007 | Friedman | |
| 2007/0087805 | A1 | 4/2007 | Taylor | |
| 2007/0102877 | A1 | 5/2007 | Personius et al. | |
| 2007/0161424 | A1 | 7/2007 | Gatto et al. | |
| 2007/0167217 | A1 | 7/2007 | Kaminkow et al. | |
| 2007/0171192 | A1* | 7/2007 | Seo et al. | 345/156 |
| 2007/0190495 | A1* | 8/2007 | Kendir et al. | 434/21 |
| 2007/0281774 | A1 | 12/2007 | Khal | |
| 2007/0287523 | A1 | 12/2007 | Esses et al. | |
| 2008/0045295 | A1 | 2/2008 | Walker et al. | |
| 2008/0076513 | A1 | 3/2008 | Esses et al. | |
| 2008/0076518 | A1 | 3/2008 | Yoshizawa | |
| 2008/0102923 | A1 | 5/2008 | Esses et al. | |
| 2008/0113769 | A1 | 5/2008 | Montero et al. | |
| 2008/0119260 | A1 | 5/2008 | Nores | |
| 2008/0119261 | A1 | 5/2008 | Heymann | |
| 2008/0153570 | A1 | 6/2008 | Esses et al. | |
| 2008/0167116 | A1 | 7/2008 | Gerson | |
| 2008/0214292 | A1 | 9/2008 | Bryant et al. | |
| 2008/0234032 | A1 | 9/2008 | Brunet de Courssou et al. | |
| 2008/0274798 | A1 | 11/2008 | Walker et al. | |
| 2008/0310302 | A1 | 12/2008 | Detwiler et al. | |
| 2008/0318660 | A1 | 12/2008 | Nores | |
| 2009/0005145 | A1 | 1/2009 | White | |
| 2009/0029773 | A1 | 1/2009 | Cherry | |
| 2009/0029779 | A1 | 1/2009 | Murase et al. | |
| 2009/0061982 | A1 | 3/2009 | Brito | |
| 2009/0064000 | A1 | 3/2009 | Garbow et al. | |
| 2009/0082080 | A1 | 3/2009 | Bennett et al. | |
| 2009/0093296 | A1 | 4/2009 | Gerson et al. | |
| 2009/0104977 | A1 | 4/2009 | Zielinski | |
| 2009/0124328 | A1 | 5/2009 | Nores | |
| 2009/0124352 | A1 | 5/2009 | Gerson | |
| 2009/0233692 | A1 | 9/2009 | Yoshizawa | |
| 2009/0239631 | A1 | 9/2009 | Aoki et al. | |
| 2009/0286586 | A1 | 11/2009 | Heymann et al. | |
| 2010/0004048 | A1 | 1/2010 | Brito | |
| 2010/0029376 | A1 | 2/2010 | Hardy et al. | |
| 2010/0029378 | A1 | 2/2010 | Gerson et al. | |
| 2010/0048284 | A1 | 2/2010 | Jaffe | |
| 2010/0210356 | A1 | 8/2010 | Losica | |
| 2010/0240456 | A1 | 9/2010 | Goto et al. | |
| 2010/0331071 | A1 | 12/2010 | Uchiyama et al. | |
| 2011/0281627 | A1 | 11/2011 | Lutnick et al. | |
| 2012/0052939 | A1 | 3/2012 | Lutnick et al. | |

FOREIGN PATENT DOCUMENTS

| | | | |
|---|---|---|---|
| GB | 2148037 | | 5/1985 |
| GB | 2335524 | | 9/1999 |
| WO | 2006076462 | A3 | 7/2006 |
| WO | 2007076514 | A3 | 7/2007 |
| WO | 2007143704 | A3 | 12/2007 |
| WO | 2008039413 | A3 | 4/2008 |
| WO | 2008051518 | A3 | 5/2008 |
| WO | 2008057188 | | 5/2008 |
| WO | 2008057201 | A3 | 5/2008 |
| WO | 2008060472 | A3 | 5/2008 |
| WO | 2008060473 | A3 | 5/2008 |
| WO | 2009032130 | A3 | 3/2009 |

OTHER PUBLICATIONS

Illinois Lottery Office of the Superintendent Game Rules, Downloaded from the World Wide Web at http://webarchive.org/web/w0061109031843/http://www.illinoislottery.com/subsections/OnLineRules.htm.

International Search Report, PCT/US2007/023658, Sep. 22, 2008.

International Search Report and Written Opinion, PCT/US2007/022775 (counterpart application to U.S. Appl. No. 11/776,508), Aug. 15, 2008.

International Searching Authority/U.S. Patent Office, International Search Report for PCT/US08/10156, Jun. 25, 2009.

International Searching Authority/U.S. Patent Office, Written Opinion of the International Searching Authority for International Application No. PCT/US07/22425, Jul. 24, 2008.

International Searching Authority/U.S. Patent Office, Written Opinion of the International Searching Authority (revised) for International Application No. PCT/US07/23656, Aug. 25, 2008.

International Searching Authority/U.S. Patent Office, Written Opinion of the International Searching Authority for International Application No. PCT/US07/23658, Sep. 22, 2008.

Lim, Seno Heno, USPTO Office Action dated Jun. 9, 2008.

"Nintendogs" instruction booklet by Nintendo of America, Inc., http://www.nintendo.com/consumer/gameslist/manuals/DS_Nintendogs.pdf, Jul. 15, 2005.

(56) References Cited

OTHER PUBLICATIONS

PCT Search Report and Opinion, PCT/US2007/022425, Jul. 24, 2008.
PCT/US2006/062630, PCT Search Report and Opinion, Mar. 17, 2008.
PCT/US2007/023656 Search Report and Opinion, Aug. 25, 2008.
PCT/US2007/070550, International Search Report, Sep. 16, 2008.
PCT/US2007/074030, Search Report and Opinion, Sep. 26, 2008.
PCT/US2008/010156, International Search Report, Jun. 25, 2009.
The International Bureau of WIPO, International Preliminary Report on Patentability and Written Opinion of the International Searching Authority for International Application PCT/US2006/000346, Jun. 15, 2006.
The International Bureau of WIPO, International Preliminary Report on Patentability and Written Opinion of the International Searching Authority for International Application PCT/US2006/001034, Nov. 7, 2007.
The International Bureau of WIPO, International Preliminary Report on Patentability and Written Opinion of the International Searching Authority for International Application PCT/US2006/062630, Mar. 17, 2008.
The International Bureau of WIPO, International Preliminary Report on Patentability and Written Opinion of the International Searching Authority for International Application PCT/US2007/20589, Apr. 1, 2008.
The International Bureau of WIPO, International Preliminary Report on Patentability and Written Opinion of the International Searching Authority for International Application PCT/US2007/022425, Jul. 24, 2008.
The International Bureau of WIPO, International Preliminary Report on Patentability and Written Opinion of the International Searching Authority for International Application PCT/US2007/022426, May 21, 2008.
The International Bureau of WIPO, International Preliminary Report on Patentability and Written Opinion of the International Searching Authority for International Application PCT/US2007/022775, Aug. 15, 2008.
The International Bureau of WIPO, International Preliminary Report on Patentability and Written Opinion of the International Searching Authority for International Application PCT/US2007/023657, Sep. 29, 2008.
The International Bureau of WIPO, International Preliminary Report on Patentability and Written Opinion of the International Searching Authority for International Application PCT/US2007/023658, Sep. 22, 2008.
Translated Office Action in Macau Economy Bureau, application No. 1/0004388(880), Apr. 17, 2009.
Wikipedia, "Wheel of Fortune," http://en.wikipedia.org/wiki/Wheel_of_Fortune, printed Dec. 8, 2008.
World Intellectual Property Organization—International Bureau, International Search Report for International Application No. PCT/US06/01034, Nov. 7, 2007.
World Intellectual Property Organization—International Bureau, International Search Report for International Application No. PCT/US06/62630, Mar. 17, 2008.
World Intellectual Property Organization—International Bureau, International Search Report for International Application No. PCT/US07/022425, Jul. 24, 2008.
World Intellectual Property Organization—International Bureau, International Search Report for International Application No. PCT/US07/022426, May 28, 2008.
World Intellectual Property Organization—International Bureau, International Search Report for International Application No. PCT/US07/20589, Apr. 1, 2008.
World Intellectual Property Organization—International Bureau, International Search Report for International Application No. PCT/US07/23657, Sep. 29, 2008.
PCT/US06/01034—WO/2006/076462 (counterpart PCT application), International Search Report, Written Opinion of the International Search Authority, Nov. 7, 2007.
U.S. Appl. No. 11/326,125, filed Jan. 3, 2006.
U.S. Appl. No. 11/337,960, filed Jan. 23, 2006.
U.S. Appl. No. 11/558,405, filed Nov. 9, 2006.
U.S. Appl. No. 11/609,315, filed Dec. 11, 2006.
U.S. Appl. No. 11/678,050, filed Feb. 22, 2007.
U.S. Appl. No. 11/764,689, filed Jun. 18, 2007.
U.S. Appl. No. 11/776,508, filed Jul. 11, 2007.
U.S. Appl. No. 11/781,941, filed Jul. 23, 2007.
U.S. Appl. No. 11/846,239, filed Aug. 28, 2007.
U.S. Appl. No. 11/860,524, filed Sep. 24, 2007.
U.S. Appl. No. 11/873,740, filed Oct. 17, 2007.
U.S. Appl. No. 11/928,413, filed Oct. 30, 2007.
U.S. Appl. No. 11/949,749, filed Dec. 3, 2007.
U.S. Appl. No. 11/952,470, filed Dec. 7, 2007.
U.S. Appl. No. 12/107,255, filed Apr. 22, 2008.
U.S. Appl. No. 12/122,110, filed May 16, 2008.
U.S. Appl. No. 12/165,335, filed Jun. 30, 2008.
U.S. Appl. No. 12/168,878, filed Jul. 7, 2008.
U.S. Appl. No. 12/495,774, filed Jun. 30, 2009.
Sony Pictures Television—Wheel of Fortune 20th Anniversary—download from http://webarchive.org/web/20030624010929/http://www.wheeloffortune.com/, Jun. 24, 2003.
U.S. Appl. No. 12/773,847, filed May 5, 2010.

* cited by examiner

SLOT MACHINE BONUS GAME PROVIDING AWARDS FOR MANUAL DEXTERITY

CROSS REFERENCE TO RELATED APPLICATIONS

This Application claims benefit of provisional application 60/862,561, filed Oct. 23, 2006, which is incorporated by reference herein in its entirety.

This Application is also related to the following ten applications identified by their application number, all ten applications are incorporated by reference herein in their entireties: Ser. Nos. 11/035,691 ("Slot Machine Game that Allows Player to Purchase Reel Respins"); 11/326,125 ("Slot Machine Bonus Game"); 11/337,960 ("Slot Machine with Skill Aspect"); 11/558,405 ("System and Method for Allowing Piggyback Wagering"); 11/609,315 ("System and Method for Allowing Piggyback Wagering"); 11/459,253 ("Slot Machine Bonus Game"); 11/558,564 ("System and Method for Administering a Progressive Jackpot Limited to a Bonus Round"); 11/678,0505 ("Slot Machine Game With Additional Features"); 11/764,689 ("Slot Machine Game with Additional Award Indicator"); and 11/776,508 ("Slot Machine Game With User Selectable Themes"). All ten of these applications are incorporated by reference herein in their entireties for all purposes. Any and all features of any of these applications can be combined with each other and with any feature(s) described herein.

BACKGROUND OF THE INVENTION

1. Field of the Invention

The present inventive concept relates to a system, method, and computer readable storage, for providing a bonus round to a slot machine game.

2. Description of the Related Art

Slot machine games are a billion dollar industry. The current three or five reel machines have been around for a long time and some players may find current game play monotonous.

What is needed is a slot machine with an exciting bonus round that will generate more excitement for players and thus potentially more revenue for the casino/manufacturer as well.

SUMMARY OF THE INVENTION

It is an aspect of the present general inventive concept to provide additional features to slot machine games.

The above aspects can also be obtained by a method that includes (a) displaying a plurality of moving elements on an output device; (b) allowing a player to select any of the moving elements using manual dexterity; (c) outputting and awarding an award associated with each element selected by the player, (d) wherein the player has a predetermined amount of time to select elements before the bonus round ends.

The above aspects can also be obtained by a method that includes (a) displaying a plurality of moving elements on an output device; (b) allowing a player to select any of the moving elements requiring manual dexterity; and (c) outputting and awarding an award associated with each element selected by the player, (d) wherein when the player has selected a termination element, the bonus round ends.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
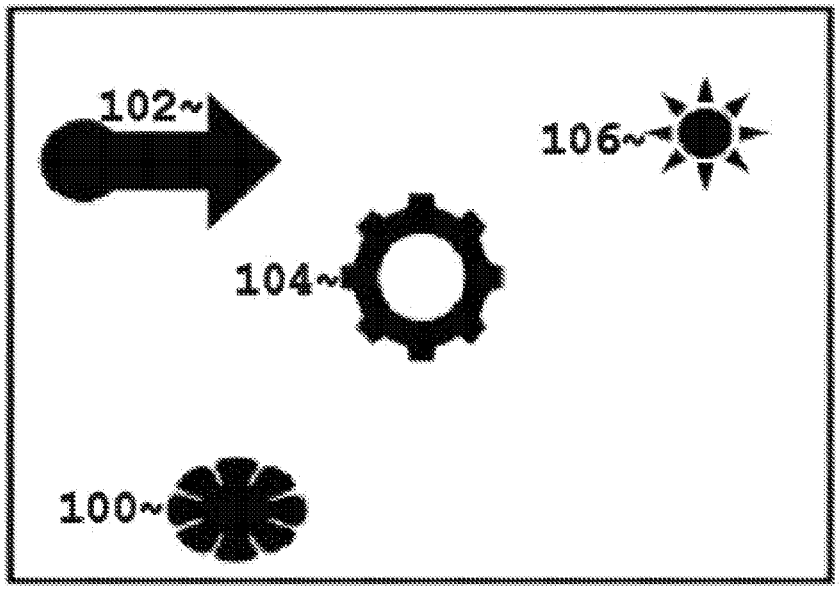
FIG. 1A is an example screen shot of a first frame of a bonus round, according to an embodiment.

Reference will now be made in detail to the presently preferred embodiments of the invention, examples of which are illustrated in the accompanying drawings, wherein like reference numerals refer to like elements throughout.

Embodiments of the invention relate to slot machine games, where typically a player places a wager, presses a button to spin the reels, the reels each stop at a random position, payouts are determined by comparing all paylines played to a predetermined set of winning combinations, and then the determined payouts, if any, are awarded to the player based on the wager. Additional features can augment the excitement of a player and may also result in increased action for the casino.

A slot machine bonus round (triggered by a triggering condition such as getting a predetermined combination on the reels) will display elements (such as boxes, doors, characters, icons, etc.). Each element can have a prize associated with the element which is not displayed or awarded to the player until the player selects that element. The elements can be stationary and/or moving. When the player selects (e.g., touches using a touch screen) an element, the element can disappear (or turn into a different appearance) and a prize can be revealed and awarded. The prize can be a coin (or cash) amount, a multiplier (which multiplies and awards a win on the previous spin of the reels, e.g., the last spin or win is multiplied by 2 or any other amount), a hint (for another bonus game), or any other incentive the player may enjoy.

The elements can be moving across the screen, either in straight or curved paths, which may make it challenging for the player to successfully touch (hence requiring dexterity). An element may start on one side of the screen and if it moves to the other side of the screen before the player touches it, that element can be removed from the screen entirely (it may or may not reappear at a later time).

The selecting of elements can be done either by a player using his fingers on a touch screen, or by using a shooter on the screen which the player can fire by pressing a button on the slot machine. The shooter can shoot a projectile which, if it intercepts an element, will then serve to "touch" that element and award its respective prize. Prizes can be predetermined for each element or can be awarded at random once an element is picked. An element that would difficult to touch (because it is moving faster and/or it is smaller) may have a higher award than an easier element to touch.

There can be two modes of operation. The first mode of operation is a finite time mode. A player is given a finite time, such as one minute, in order to touch as many elements as possible. Each element that is touched (or selected, hit, etc.) would reveal and accumulate a respective award for the touched element. Of course, the player would try as best as he or she could to touch as many elements as possible in the given time in order to earn as many awards as possible. When a predetermined one minute (or other amount of time) is up, the bonus round ends and the cumulative sum of the awards that are outputted to the player are added to the player's credit meter and the player can continue to play the main slot game. The more dexterous player may do better at this bonus round than an unskilled player, since the dexterous player may be able to touch more icons and may have better chances to touch icons that may have a higher award (e.g., faster and/or smaller icons).

The second mode of operation is an infinite time mode. In this mode, the player is given infinite time in the bonus round to touch elements, and the bonus round is terminated by a terminating condition. For example, one or more of the elements may have a terminating symbol (e.g., a bomb), which ends the bonus round. Alternatively, more than one terminating symbol may be required to end the bonus round (e.g., when the player touches three bombs the bonus round ends). Otherwise, similar to the finite time mode.

Figure 1B:
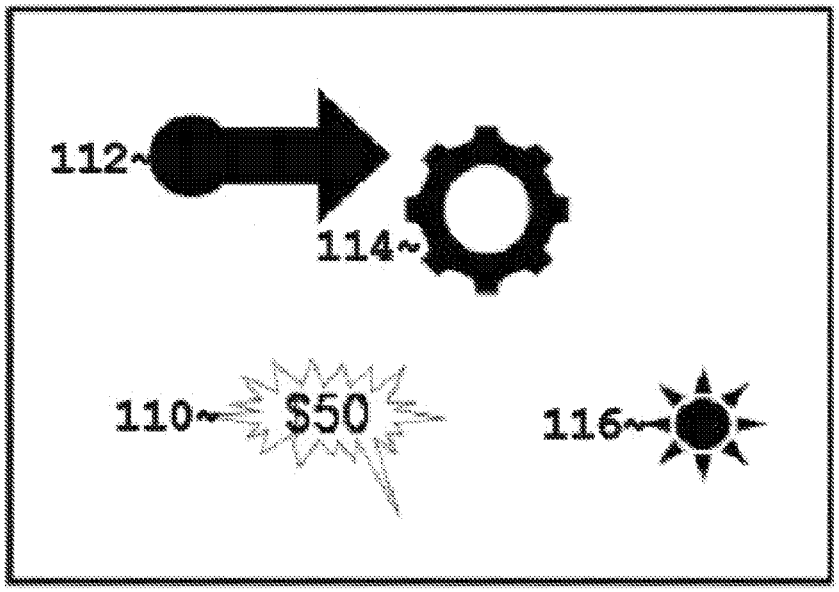
FIG. 1B is an example screen shot of a second frame (later in time than the first frame in FIG. 1A) of a bonus round, according to an embodiment.

FIG. 1A is an example screen shot of a first frame of a bonus round, according to an embodiment. FIG. 1B is an example screen shot of a second frame (later in time than the first frame) of a bonus round, according to an embodiment.

FIGS. 1A and 1B illustrate an example of moving elements. Four elements are displayed in the first frame, and the elements all move (although some elements may remain stationary) and form a later frame (FIG. 1B). Note that some elements are bigger than others, and some are moving more quickly than others. In between FIGS. 1A and 1B, a player has touched the element on the bottom of FIG. 1, and thus in FIG. 2, the player has won a prize of $50. Since the sun (element on the right) is relatively small and moving relatively fast, it can (but not required to) have a higher award than the slower moving elements (such as the gear). Thus, a player would exercise his dexterity by trying to touch the higher valued elements.

It is noted that icons are not required to move, and some can remain stationary. Such icons can appear and disappear randomly in a finite period of time, and so if the player is not quick enough to touch the icon before it disappears, then the player has missed his or her chance to touch that icon and gain its respective award. The location of the icon can be random and the amount of time the icon is available to be touched can also be random (or alternatively predetermined as well). The appearance of the stationary icon (like the moving icons) can also be random as well.

After the bonus round is over, then awards for each of the icons can be outputted to the player so the player can see which icon would have resulted in which award. The outputted awards can either be the real awards associated with the icon, or if the awards are determined randomly upon touching, then random awards can be outputted (the player would typically not know that these are not the actual awards the player would have earned for each icon).

Further, icons with different characteristics can have different values. Smaller and/or faster icons can have higher values, although this is not required. The values for each icon can be predetermined by the game designers, or chosen at random. For example, a small icon may have an award associated with it determined by a random number from $10 to $20. A larger icon may have an award associated with determined by a random number from $2 to $5. Faster and slower icon award amounts can be determined similarly. A faster, smaller icon may have a higher expected award than a faster, larger icon or a slower, smaller icon, or a slower, larger icon, and may, for example, be determined by a random number from $20 to $50. A table can be used of icons and their respective characteristics to determine their actual values or methods to determine their values.

At the end of the bonus round, the player may be given the option to return to the main game or use any credits the player has earned in the bonus round to buy his or her way into a further bonus round. For example, if the player has won $100 in the bonus round, the player can be presented with an option to return to the main game, or pay $50 and play a further bonus round. The further bonus round may have the same parameters as the bonus round the player has just completed, or the parameters may be different (e.g., different shapes, prize structures, etc.)

Figure 2:
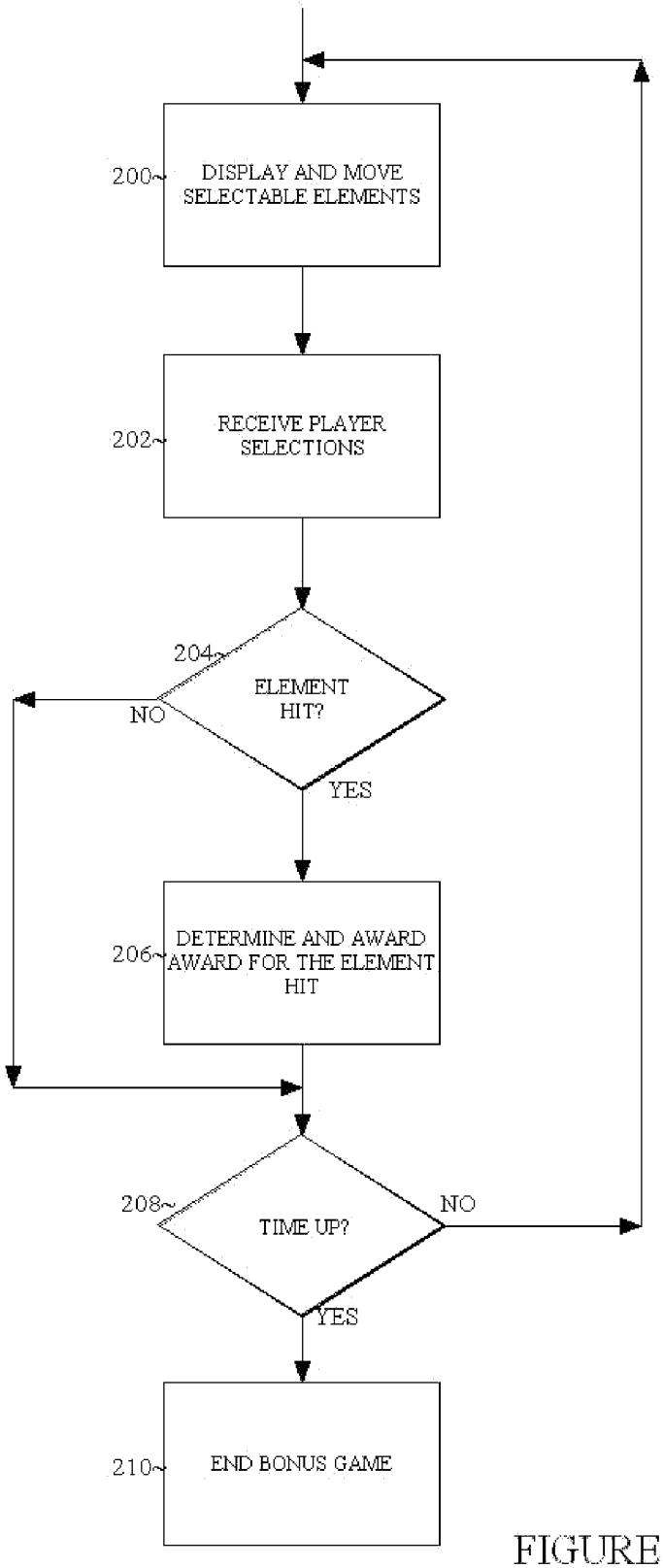
FIG. 2 is a flowchart illustrating an exemplary method to implement a bonus round, according to an embodiment.

FIG. 2 is a flowchart illustrating an exemplary method to implement a bonus round, according to an embodiment.

The method starts with operation 200, which displays and moves selectable elements. The selectable elements can appear on an output device as animated objects, characters, etc. The selectable elements will move automatically.

From operation 200, the method can proceed to operation 202, which receives player selections. The player can select (or attempt to select) the moving (or stationary) elements in order to attempt to select them.

From operation 202, the method can proceed to operation 204, which determines whether an element was selected (hit). If not, the method can proceed to operation 208, which determines whether the allotted time is up for the bonus round. If the time is up, then the method can proceed to operation 210, which ends the bonus game. Any awards that have been earned are accumulated and awarded to the player.

From operation 204, if an element was hit, then the method can proceed to operation 206, which determines an award for the hit element and awards the award to the player. The award can be determined in a number of ways. For example, each selectable element can have a fixed award associated with it.

Awards for each element can be commensurate with the difficulty the player may have in selecting that particular element. For example, a faster moving element can have a higher award than a slower moving element. A smaller element can have a higher award than a bigger element. For example, table I is an exemplary table illustrating elements and their associated awards. The size can be in terms of pixels, and the speed can be pixels/second of motion. All of the elements listed (all 8) can appear on the screen at the same time. Alternatively, not all elements need be present on the screen at the same time, and some elements can appear/disappear on the screen randomly. Motion of the elements can be in a random or predetermined direction.

TABLE I

| Element number | Size | speed | award |
|---|---|---|---|
| 1 | 15 | 200 | $5 |
| 2 | 15 | 300 | $8 |
| 3 | 15 | 400 | $10 |
| 4 | 20 | 200 | $4 |
| 5 | 30 | 200 | $2 |
| 6 | 35 | 100 | $1 |

TABLE I-continued

| Element number | Size | speed | award |
|---|---|---|---|
| 7 | 10 | 450 | $50 |
| 8 | 5 | 700 | $100 |

Note that the awards illustrated in Table I are actual awards. Awards can also be determined based on both characteristics of the element selected as well as random characteristics as well. For example, awards can be awarded using a random number from 1 to the number in the award column in Table I. Thus, awards may vary based on random numbers, the expected award can still be determined and will be based on characteristics of the selected element the award is being based on.

Figure 3A:
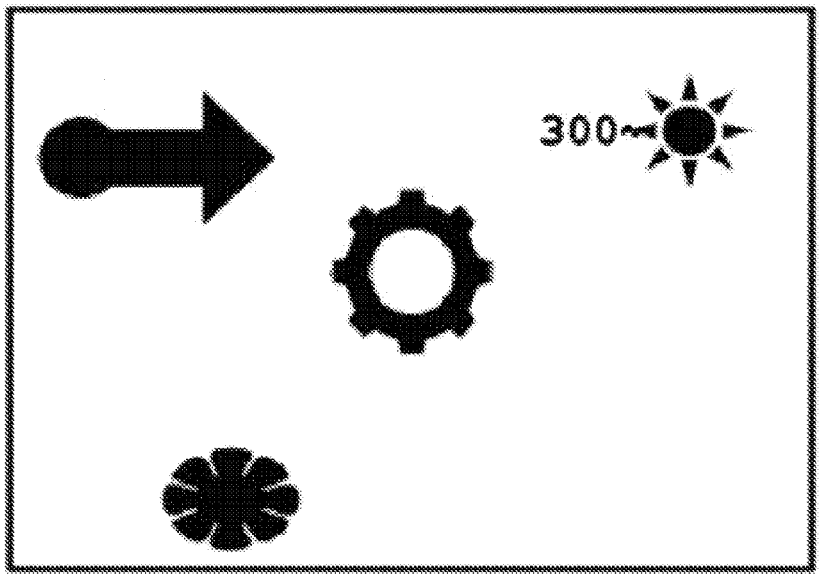
FIG. 3A is a further example screen shot of a first frame of a bonus round, according to an embodiment.

FIG. 3A is a further example screen shot of a first frame of a bonus round, according to an embodiment. A sun 300 is one of the selectable elements which is moving in a downward direction.

Figure 3B:
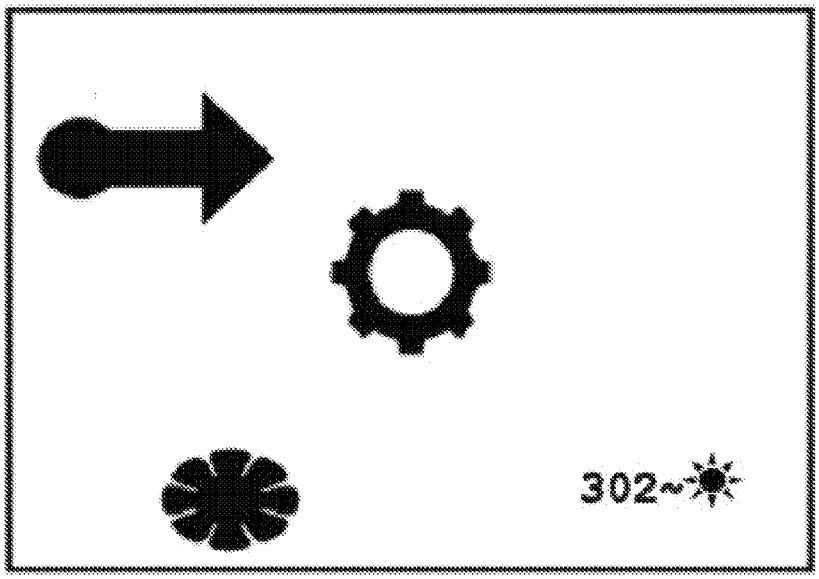
FIG. 3B is a further example screen shot of a second frame (later in time than the first frame in FIG. 3A) of a bonus round, according to an embodiment.

FIG. 3B is a further example screen shot of a second frame (later in time than the first frame in FIG. 3A) of a bonus round, according to an embodiment. Note the sun 302 has shrunk. Elements can expand and shrink in size while they are moving.

In an embodiment, the award earned by the player when an element is successfully selected can vary based on dynamic characteristics of the element. For example, an element that has the characteristics of element #4 from Table I (size 20, speed 200) can change (while moving on the screen) to other characteristics (such as element #5 size 30, speed 200). If the player successfully selects the element while having the smaller size, the player would win $4, while if the player successfully selects the element while it is the bigger size the player would win $2.

Elements can change size, speed, or other characteristics. Based on the difficulty of selecting the respective element based on its characteristics, the award for that element will also dynamically change to correspond to the difficulty. Awards can discretely change as in the example above, or a formulaic approach can be used. For example, an award can be computed as: C*(speed/size), wherein C is a constant, and speed and size are determined at the time the element was successfully selected (e.g., touched, shot, etc.) Thus characteristics of elements can dynamically change while being displayed on the output device and the award for selecting the respective element would change respectively based on the difficulty of selecting the element at the time it was selected.

Further, the award computed as C*(speed/size) can also be multiplied by R, wherein R is a random number from 0.5 to 1.25 (or any other range). This gives some aspect of randomness to the determination of the award, thus each award earned may have an element of a "surprise factor" to the player since the player will not know for sure what the award is until the player actually successfully selects the respective element.

In an alternative embodiment, award amounts can be displayed alongside each element. As awards may change based on dynamic characteristics of the element, the displayed award may change as well.

In yet a further embodiment, instead of awarding monetary awards, the awards can be a multiplier of a prior award. For example, a player spins reels of a slot machine and wins an award of $10 and also an entry into the bonus round (by achieving a predetermined combination of symbols). When the player successfully selects elements, the player will be awarded with a multiplier of the prior award ($10). The multipliers can accumulate with each successfully selected element. For example, if during a bonus round, the player selects a (1× multiplier a 3× multiplier, and a 1.5× multiplier before the bonus round ends), then the player will have earned an accumulated multiplier of 5.5× which is multiplied by the prior award of $10, thus the player has won an additional $55. Awards associated with the elements can also be mixed, e.g., they can contain both monetary awards and multipliers.

In a further embodiment, instead of the bonus round being timed, the bonus round can end when an icon is selected that triggers an end of the bonus round.

Figure 4:
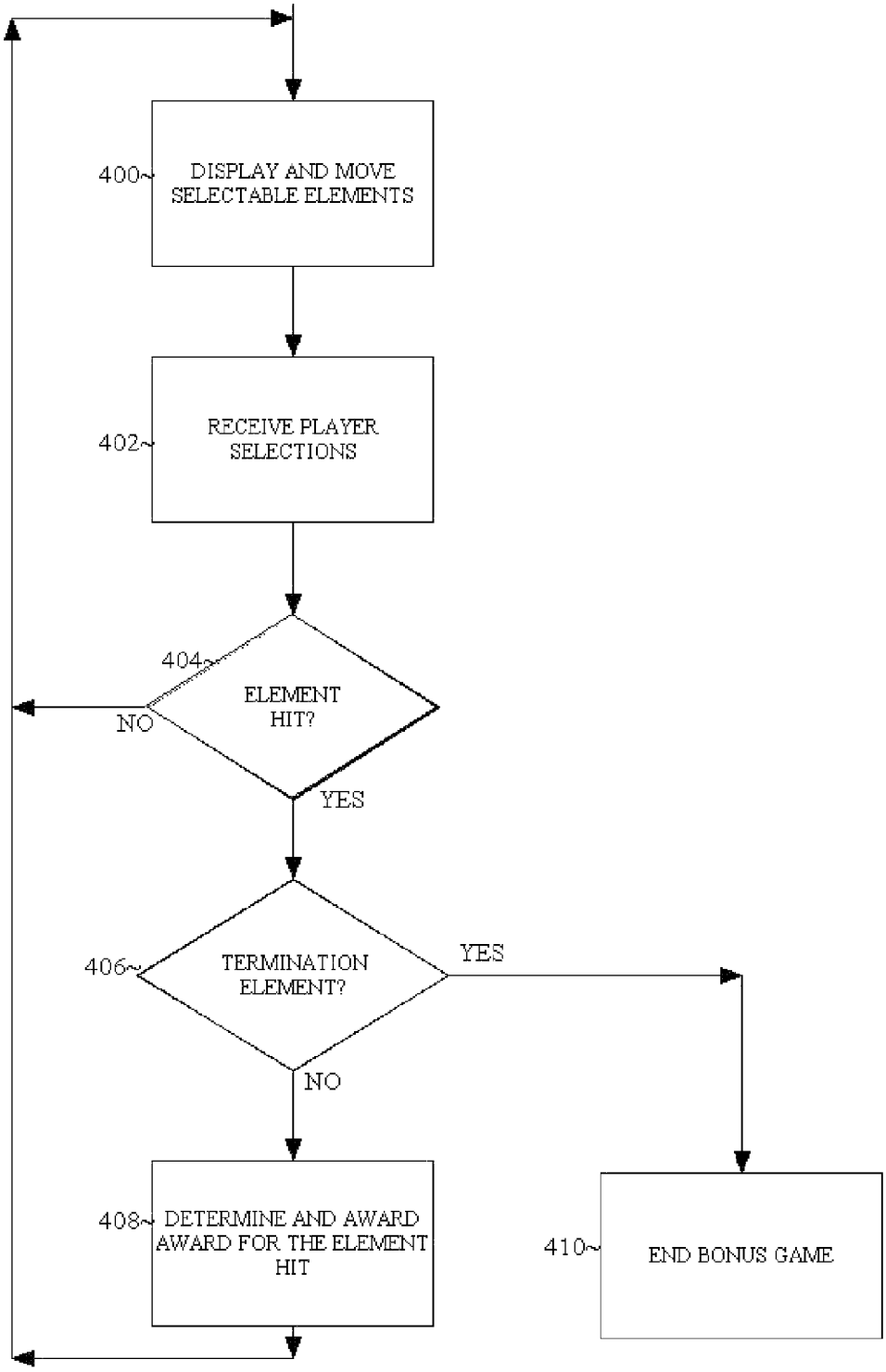
FIG. 4 is a flowchart illustrating an exemplary method to implement a bonus round, according to an embodiment.

FIG. 4 is a flowchart illustrating an exemplary method to implement a bonus round using a termination element, according to an embodiment.

The method illustrated in FIG. 4 operates like the method illustrated in FIG. 2, except that a termination element is used to end the bonus round. Some element(s) available for selection by the player are termination elements, which will end the bonus round.

Operations 400, 402, 404, 408, and 410 operate as their counterpart operations in FIG. 2. In operation 406, if the element hit (or selected) by the player, in operation 404, is a termination element, then the method proceeds to operation 410, wherein the bonus round ends.

A termination element can be predetermined to be a termination element, or it can be determined randomly upon selection that it is a termination element. Of course, the status of an element as a termination element is not displayed to the player because the player would not wish to select a termination element.

In a further embodiment, a termination element (illustrated in FIG. 4) can be combined with the timed bonus round (illustrated in FIG. 2). Thus, a bonus round can be given a predetermined allotted time (e.g., 30 seconds). If the player selects a termination element during the bonus round, then the bonus round will end at that point in time. If the player does not select a termination element during the bonus round, then the bonus round will end after the predetermined allotted time. For example, a bonus round can have a predetermined time of 30 seconds. If the player does not select a termination element, then the bonus round would automatically end after 30 seconds. If, after 15 seconds, the player picks a termination element, then the bonus round would immediately end. Of course, the player desires not to select (or pick) a termination element so that the bonus round would end after the predetermined time (the maximum allotted time).

Figure 5:
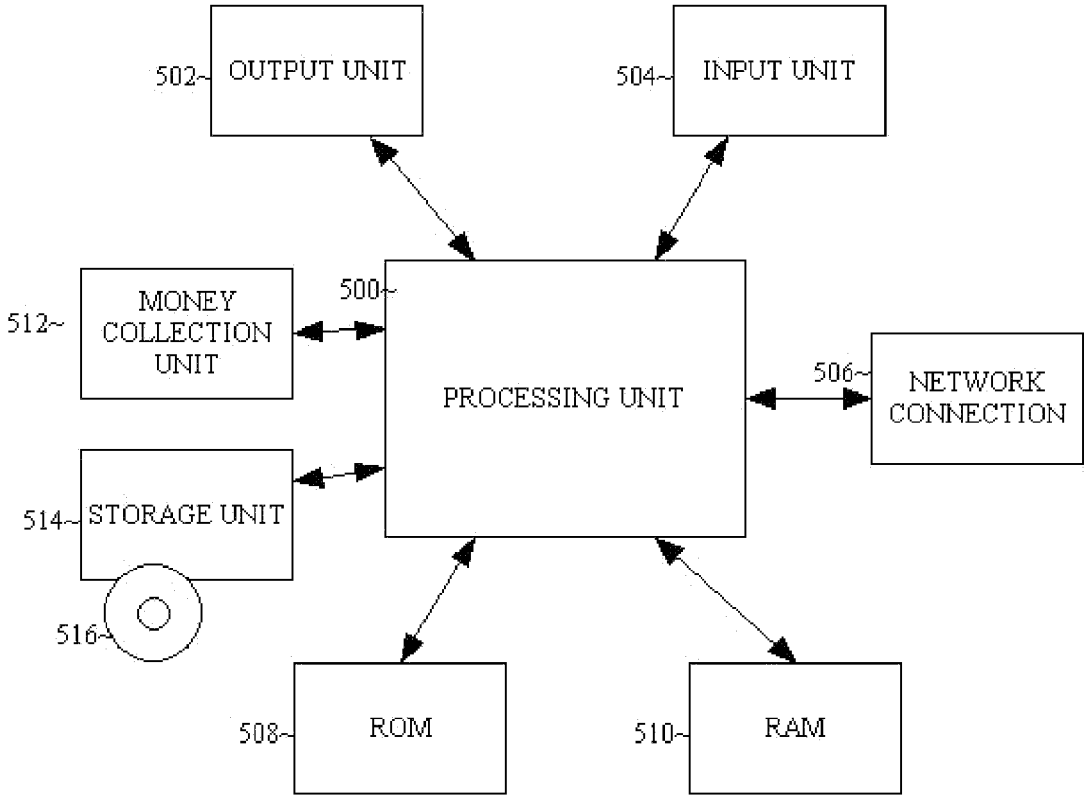
FIG. 5 is a block diagram of one example of hardware that can be used to implement the method, according to an embodiment.

FIG. 5 is a block diagram of one example of hardware that can be used to implement the method, according to an embodiment.

A processing unit 500 (which can comprise a microprocessor and related components) can be connected to an output unit 502 (e.g., LCD or touch screen, etc.), an input unit 504 (e.g. a touch screen, keyboard, buttons, etc.), a network connection 506 (e.g. connection to a casino server or the Internet or other communication network), a ROM 508, a RAM 510, and any other hardware known in the art needed to implemented a digital version of the game (not pictured). The game can also be served to a remote client playing at an online casino over a computer communications network (such as the internet). A money collection unit 512 can be used to receive cash (e.g., a bill acceptor), or other payment from such as electronic payment and credit. A storage unit 514 can be a CD-ROM drive, a DVD-ROM drive, or any device that can read a computer readable storage medium. A CD-ROM 516 (or any other type of computer readable storage medium) can be read by the storage unit 514 and can contain data, assets, programs, etc., in order to implement the methods described herein Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The descriptions provided herein also include any hardware and/or software known in the art and needed to implement the operations described herein. All components illustrated herein may also optionally communicate with any other illustrated or described component.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement and terminate a bonus round on a slot machine, the method comprising:

displaying, by a display device connected to a processing unit, a plurality of moving elements selectable during at least part of the bonus round, wherein a size and speed of at least some of the plurality of moving elements change while displayed by the display device;

receiving by the processing unit from an input unit during the bonus round, a player selection of a first moving element from among the plurality of moving elements;

determining, randomly by the processing unit, that the first moving element is a termination element, wherein the first moving element is not predetermined to be the termination element prior to receiving the player selection; and terminating the bonus round in response to the processing unit determining the first moving element is the termination element.

2. The method as recited in claim 1, wherein selection of a moving element from among the plurality of moving elements comprises the element being touched on a touch screen input/output device.

3. The method as recited in claim 1, wherein selection of a moving element from among the plurality of moving elements comprises shooting a projectile from a shooter displayed on the display device, and wherein shooting the projectile occurs in response to pressing a button.

4. The method as recited in claim 1, further comprising:

receiving, by the processing unit from the input unit during the bonus round, but prior to receiving the player selection of the first moving element, a player selection of a second moving element from among the plurality of moving elements;

determining, by the processing unit after receiving the player selection of the second element, that the second moving element is not the termination element;

determining, by the processing unit, an award for the player selection of the second element, wherein an amount of the award is dependent upon a size and speed of the selected second element at a time the second element is selected; and outputting the award for the player selection of the second element.

5. The method of claim 4, wherein the award is selected from a set of selectable awards, wherein the set of selectable awards include multiple awards associated with a common speed, but associated with a different size, wherein a largest award of the multiple awards is associated with the smallest size of the different sizes, and wherein a smallest award of the multiple awards is associated with the largest size of the different sizes.

6. The method of claim 4, wherein the award is selected from a set of selectable awards, wherein the set of selectable awards include multiple awards associated with a common size, but associated with a different speed, wherein a largest award of the multiple awards is associated with the slowest speed of the different speeds, and wherein a smallest award of the multiple awards is associated with the fastest speed of the different speeds.

7. The method of claim 4, wherein the processing unit determines the award for the player selection of the second element using a formula that includes at least a constant, a speed value determined at a time the second element is selected by the input unit, and a size value determined at the time the second element is selected by the input unit.

8. The method of claim 1, wherein one or more of the moving elements disappears from the display device randomly.

9. The method of claim 1, wherein one or more of the moving elements appears on the display device randomly.

10. The method of claim 1, further comprising:

displaying, by the display device, a stationary element selectable to cause the processing unit to determine whether the stationary element is a termination element or an award.

11. The method as recited in claim 4, wherein the award dependent upon the size and the speed of the selected second element is a multiplier which results in a cash award determined by multiplying an award won during a game that triggers entry into the bonus round by the multiplier.

12. A slot machine to implement and terminate a bonus round, the slot machine comprising:

a processing unit;

a non-transitory computer-readable data storage unit comprising computer-readable program instructions executable by the processing unit;

a display device connected to the processing unit, wherein the display device is configured to display a plurality of moving elements selectable during at least a part of the bonus round, wherein a size and speed of at least some of the plurality of moving elements change while displayed by the display device; and an input unit connected to the processing unit, wherein the input unit is configured to receive a player selection of a first moving element from among the plurality of moving elements displayed via the display device during at least the part of the bonus round, wherein the processing unit is programmed to execute the computer-readable program instructions so as to determine randomly that the first moving element is a termination element and to terminate the bonus round in response to the processing unit determining the first moving element is the termination element, wherein the first moving element is not predetermined to be the termination element prior to receiving the player selection.

13. The slot machine of claim 12, wherein the processing unit, the data storage unit, the display device, and the input unit are part of a multi-reel slot machine.

14. The slot machine of claim 12, wherein the processing unit determines an award awarded for a player selection of a second element using a formula that includes at least a constant, a speed value determined at a time the second element is selected by the input unit, and a size value determined at the time the second element is selected by the input unit.

15. The slot machine of claim 12, wherein one or more of the moving elements disappears from the display device randomly.

16. The slot machine of claim 12, wherein one or more of the moving elements appears on the display device randomly.

17. The slot machine of claim 12, wherein the display device is further configured to display a stationary element selectable to cause the processing unit to determine whether the stationary element is a termination element or an award.

18. The slot machine system of claim 14, wherein the award awarded for the player selection of the second element equals the constant times the speed value divided by the size value.

19. The slot machine system of claim 18, wherein a size of the second element is specified in terms of pixels, and wherein a speed of the second element is specified as a ratio of pixels per seconds of motion.

20. The slot machine system of claim 14, wherein the award awarded for the player selection of the second element equals the constant times the speed value divided by the size value.

* * * * *